United States Patent [19]

Morck, Jr.

[11] 4,239,481

[45] Dec. 16, 1980

[54] DOUBLE ORIFICE VORTEX BURNER FOR LOW OR HIGH WOBBE FUELS

[75] Inventor: Charles W. Morck, Jr., Philadelphia, Pa.

[73] Assignee: Selas Corporation of America, Dresher, Pa.

[21] Appl. No.: 916,756

[22] Filed: Jun. 19, 1978

[51] Int. Cl.[3] ..... F23D 13/12

[52] U.S. Cl. ..... 431/284; 431/348; 239/404

[58] Field of Search ..... 431/348, 174, 175, 284, 431/285; 239/404, 400

[56] References Cited

U.S. PATENT DOCUMENTS

| | | | |
|---|---|---|---|
| 1,658,784 | 2/1928 | Williams | 239/404 |
| 1,808,120 | 6/1931 | Ruhkwitz | 431/284 |
| 1,875,808 | 9/1932 | Gerquest | 431/174 |
| 3,692,460 | 9/1972 | Morck | 431/348 |

*Primary Examiner*—Carroll B. Dority, Jr.
*Attorney, Agent, or Firm*—Miller & Prestia

[57] ABSTRACT

A vortex burner includes a first feed pipe and a second feed pipe disposed within the first feed pipe. A first set of gas distribution tubes extends from an end of the first feed pipe and extends towards a radiant cup portion of the vortex burner. Also, a second set of gas distribution tubes extends from the second feed pipe also toward the radiant cup portion of the vortex burner. A first fuel gas is capable of flowing through a portion of the first feed pipe not occupied by the second feed pipe, i.e. an annulus area of space, and through the associated first set of gas distribution tubes. A second fuel gas, of either a higher or lower Wobbe index than the first fuel gas is capable of flowing through the second feed pipe and its associated second set of gas distribution tubes. Thus, the vortex burner is capable of burning either high or low Wobbe fuel gases. The first and second fuel pipes may also be separately disposed within the vortex burner.

22 Claims, 5 Drawing Figures

DOUBLE ORIFICE VORTEX BURNER FOR LOW OR HIGH WOBBE FUELS

BACKGROUND OF THE INVENTION

The present invention relates to a vortex burner, and more particularly a vortex burner capable of burning either high or low Wobbe fuel gases.

Vortex burners are utilized in industrial type furnaces. A vortex burner is typically a nozzle mix burner which utilizes the tangential energy of the fuel gas, assisted by furnace draft, to entrain combustion air, mix the combustion air with the gas, and inject the burning mixture onto a radiant cup portion of the burner and along the furnace wall.

In the troubled energy situation we find ourselves in today, one cannot always rely on one particular type of gas for utilization as the fuel gas of a vortex burner. That is to say, at one period of time natural gas will be available while at another time a higher Wobbe gas such as propane or butane, will be all that is available.

The Wobbe index of a gas is a measure of the amount of heat released by the gas with a constant orifice, equal to the gross calorific valve of the gas in British thermal units (Btu) per cubic foot ($ft^3$) at standard temperature and pressure divided by the square root of the specific gravity of the gas.

The conventional vortex burner typically has two #30 gas jets sized to obtain 1.25 MM Btu/hr rated capacity at 20 psig gas pressure and 0.2" W.C. draft per natural gas. The performance of such a vortex burner is acceptable for gases up to about 1600 Wobbe. Beyond a rating of 1600 Wobbe luminous tips and torching becomes objectionable. These objectionable features result from the reduced burner efficiency caused by the lower gas flows needed to obtain the same Btu release for the higher Wobbe fuels with high Btu content. Small gas jets and higher pressures are therefore necessary to obtain satisfactory performance on propane and other high Wobbe fuels, but the small orifices are unsuited for natural gas because of the high gas pressure required to obtain the rated capacity. However, having to change the spuds of a vortex burner so as to be able to burn fuels over a wide Wobbe range is very inefficient and costly.

Therefore, it would be quite desirable to those in industry utilizing vortex burners, to have such a burner which is capable of operating with gases over a wide Wobbe range without having the necessity of changing spuds.

SUMMARY OF THE INVENTION

A vortex burner for burning either high or low Wobbe fuels includes a burner block having a cup-shaped recess at one surface of the block and an opening extending from the base of the cup-shpaed recess and extending to the opposite surface of the block. A burner tube is adjacent to and extends through the block opening. The burner tube terminates in the vicinity of the base of the cup-shaped recess. The burner tube includes an annular shaped fence which extends from the inner surface of the burner tube and is in the vicinity of the burner tube end closest to the cup-shaped recess. A first feed pipe is disposed within the burner tube. The first feed pipe is capbable of carrying a first fuel gas. A second feed pipe is disposed within the first feed pipe. The second feed pipe is capable of carrying a second fuel gas of either a higher or lower Wobbe index than that of the first fuel gas. A first set of gas distribution tubes extends from the first feed pipe, through the fence opening such that the terminal orifices of the tubes are at least in proximity to the front surface of the fence. The first set of gas distribution tubes is capable of carrying gas which flows through that portion of the first feed pipe not occupied by said second feed pipe. A second set of gas distribution tubes extends from the second feed pipe and through the fence opening such that the terminal orifices of the second set of tubes are at least in proximity to the front surface of the fence. The first set of gas distribution tubes is capable of carrying the second fuel gas which flows through the second feed pipe.

DETAILED DESCRIPTION OF THE INVENTION

Figure 1:
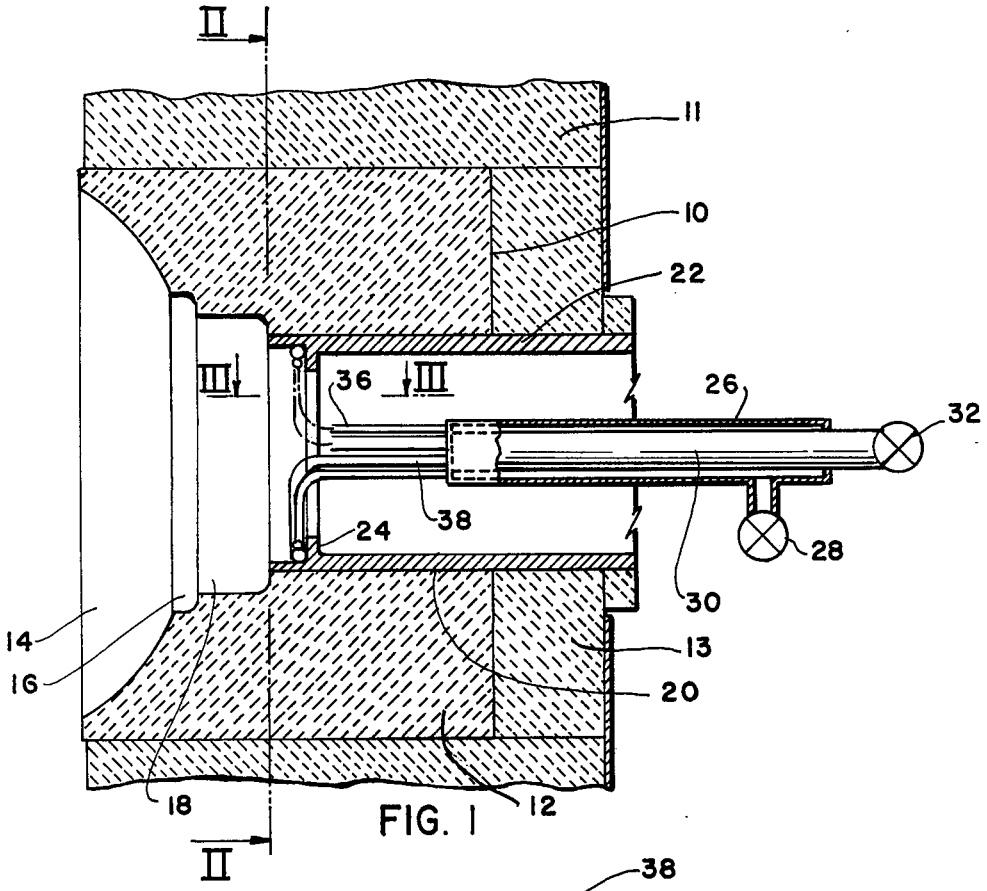
FIG. 1 is a cross-sectional view of a vortex burner of the present invention.
Figure 2:
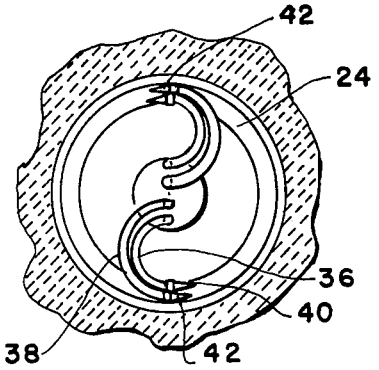
FIG. 2 is a view of the vortex burner of FIG. 1 along the II—II plane.
Figure 3:
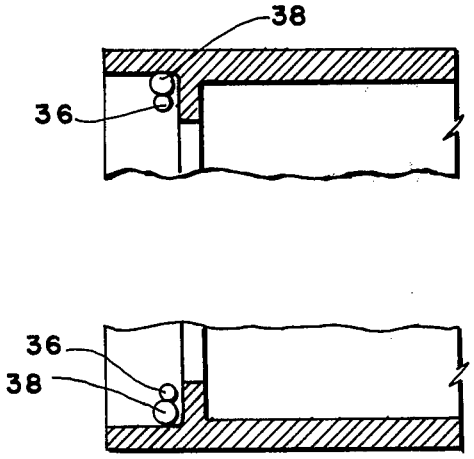
FIG. 3 is a cross-sectional view of the vortex burner along the III—III plane.

Referring to the FIGS. 1 to 3, the vortex burner of the present invention is designated as 10. The vortex burner 10 of the present invention is shown in FIG. 1 as being in a portion of a furnace wall 11. Typically the furnace wall is of a refractory type material. The vortex burner 10 includes a burner block 12 which is disposed within the furnace wall 11, and is also of a refractory type material. Behind burner block 12 is a well tile 13 which is also of a refractory type material. The burner block 12 includes at one surface a cup-shaped recess 14, i.e., a concave cup. Extending from the base of the cup-shaped recess 14 is a series of cylindrical openings of decreasing diameter designated as 16, 18 and 20. Cylindrical opening 20 extends through the furnace block 12 and to the outside surface of the furnace wall 11.

A burner tube 22 is adjacent to and extends through the cylindrical opening 20 and terminates at the base of the cylindrical opening 18. Formed on the inner surface of the burner tube 22 and extending out from this inner surface is an annular shaped fence 24. The annular shaped fence 24 is disposed on the burner tube 22 toward the base of the cup-shaped recess 14. The burner tube 22 and fence 24 are typically of a metal.

Disposed within the burner tube 22 is a first feed pipe 26. The first feed pipe 26 is typically of a metal and is supported within the burner tube 22 by conventional supporting means. Near the end of the first feed pipe 26 farthest from the burner tube is a first gas inlet means 28. Typically, the first gas inlet means is a conventional valve for regulating the first fuel gas which is capable of flowing through the feed pipe 26.

Disposed within the first feed pipe 26 is a second feed pipe 30, also typically of a metal. At the end of the second feed pipe 30 farthest from the burner tube 22 is a second gas inlet means 32 which is also typically a conventional valve. The second gas inlet means 32 controls a second fuel gas which is capable of flowing through the second feed pipe 30. It is to be noted that the first fuel gas flows only through that portion of the first feed pipe 26 not occupied by the second feed pipe 30, i.e., an annulus area or space, while the second fuel gas flows only through the second feed pipe 30.

As will be more fully understood from the preceding description, while one of the fuel gases will be of a fuel having a low Wobbe index, i.e., about 1600 Wobbe index or less, the other fuel gas will be of a gas of a high Wobbe index, i.e., a Wobbe index greater than 1600, for example, propane or butane. It does not necessarily matter which of the fuel gases, i.e., either the first fuel gas or the second fuel gas, is of the high or low Wobbe index. However, for the purpose of describing the present invention, it will be assumed that the first fuel gas is of a high Wobbe rating, i.e. either propane or butane while the second fuel gas is natural gas.

A first set of gas distribution tubes 36 extends from the end of the first feed pipe 26 and through the fence 24 opening, such that the terminal orifices of the tubes 36 are at least in proximity to the front surface of the fence 24. More specifically, the terminal orifices of the first set of tubes 36 are tangentially positioned about the front surface of the fence 24. The first set of gas distribution tubes 36 is connected to the first feed pipe such that only the first fuel gas is capable of flowing therethrough, i.e., the fuel having the higher Wobbe rating.

A second set of gas distribution tubes 38 extends from the second feed pipe 30, and through the fence 24 opening such that their terminal orifices are at least in proximity to the front surface of the fence 24. More specifically, the terminal orifices of the second set of tubes 38 are tangentially positioned about the front surface of the fence 24. The second set of gas distribution tubes 38 is capable of carrying the second fuel gas, i.e., in this case natural gas, which flows from the second feed pipe 30. Since the first set of tubes 36 is designated for carrying gas having the high Wobbe index, these tubes are be of a smaller diameter than the second set of tubes 38. Likewise, since the annulus space between the first and second feed pipes is to carry the higher Wobbe index fuel gas, the cross-sectional area of the annulus space is smaller than that of the second feed pipe. It is well understood by those skilled in the art that more of the gas with the lower Wobbe index is needed to provide an energy release in Btu's/hr equivalent to that of the gas of the higher Wobbe index, and thus the difference in tube diameter. Of course if the fuel of the lower Wobbe index were carried by the annulus space and the first set of tubes the relative area and sizes would be the opposite of that described. The first and second sets of gas distribution tubes 36 and 38 are positioned about the front surface of the fence 24 such that one tube from each set accompanies one tube of the other set in its tangential position about the front surface of the fence 24. Positioning both sets of tubes 36 and 38 tangentially about the front surface of the fence 24 is the preferable arrangement of the tubes 36 and 38, since it provides the least interference to the gas flow about the burner recess. It should be recognized that the set of tubes positioned too close to the opening in the fence 24 (no closer than about 1/16 of an inch) as to prevent pump-back of the gas delivered by this particular set of tubes.

Figure 4:
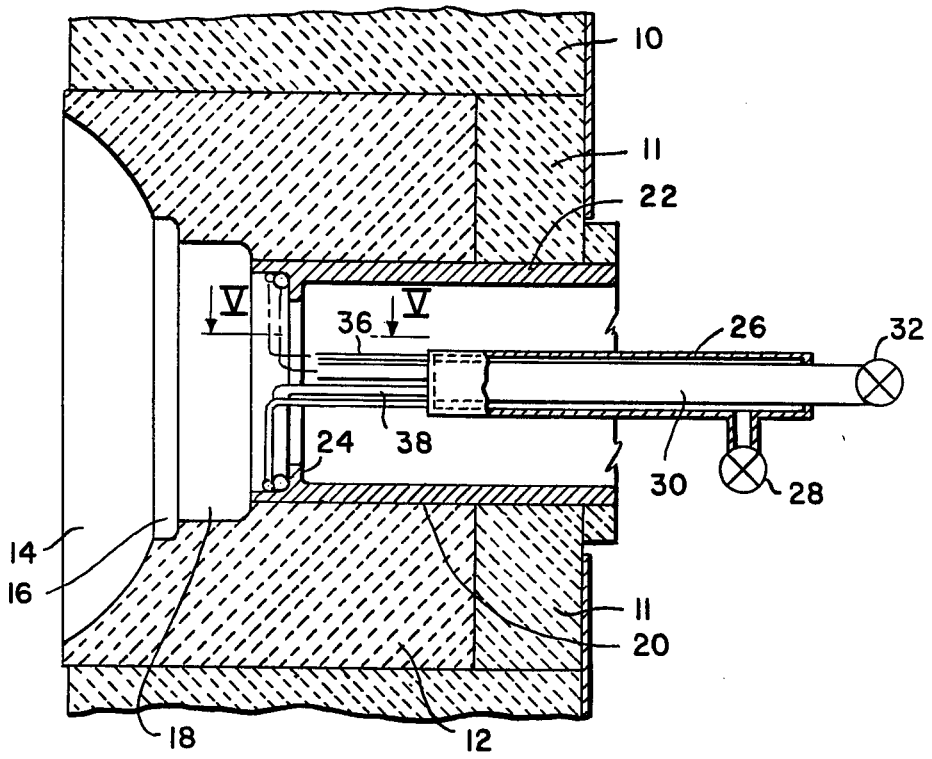
FIG. 4 is a cross-sectional view of a vortex burner of the present invention wherein one set of gas distribution tubes is above the other set of gas distribution tubes.
Figure 6:
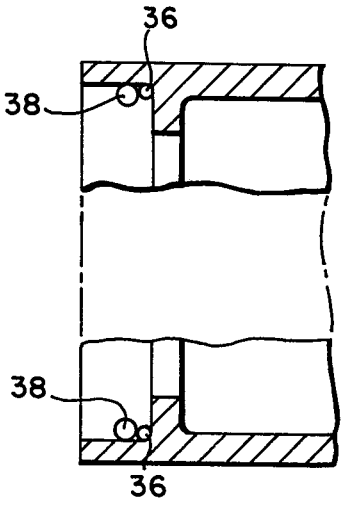
FIG. 6 is a cross-sectional view, similar to that of-FIG. 5, but showing an alternative arrangement of the gas distribution tubes.
Figure 5:
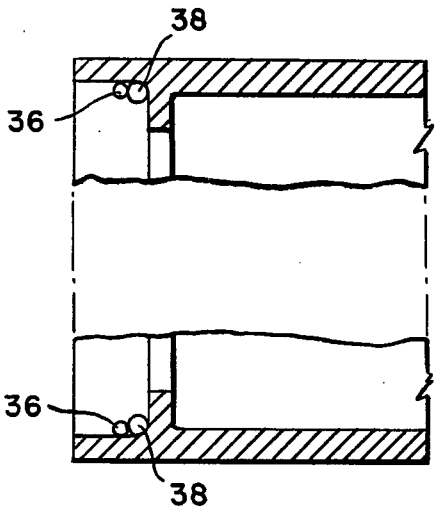
FIG. 5 is a cross-sectional view of the vortex burner of FIG. 5 along the V—V plane.

Referring to FIGS. 4 and 5, the first and second set of tubes 36 and 38 are shown where one set of the tubes is tangential to the front surface of the fence 24 and each of the other set is shown spaced approximately from the front surface of the fence 24 by the tangentially positioned tube. For the purpose of describing the present invention, the second set of tubes 38 is shown as being in the tangential position and the first set of tubes 36 is in the spaced position. The tube arrangement as described and shown in FIGS. 4 and 5 is certainly acceptable for practicing the present invention. However, this arrangement does provide more interference with the gas flow than the first arrangement described in FIG. 1. Except for the tube arrangement, FIGS. 4 and 5 are identical to FIGS. 1 and 3. It is further anticipated by the present invention that other arrangements of the tubes can be instituted without departing from the scope of the present invention. For instance, in FIG. 6, one such arrangement is shown wherein the first set of distribution tubes 36 are tangentially positioned about the front surface of fence 24 and the second set of distribution tubes 38 are spaced in proximity to the first set, by the tantentially positioned first.

On the terminal orifices of the first set of gas distribution tubes 36 is a first set of gas jets 40, i.e., spuds. The first set of gas jets 40 should be suitable for providing the proper pressure for combustion of the first fuel gas. In this particular example, the first fuel gas has the higher Wobbe index. A conventional gas jet meeting such requirements will typically have a #54 orifice to obtain 1.25 MM Btu/hr rated capacity at 100 psig gas pressure and 0.2" W.C. draft for a high Wobbe gas such as propane or butane, assuming the first set of gas distribution tubes has an outside diameter of 3/16" with a 1/32" wall. The high Wobbe index range which the present invention anticipates is from about 1600 to 2300.

On the terminal orifices of the second set of gas distribution tubes are attached a second set of gas jets 42. The second set of gas jets 42 is typically of a standard variety suitable for providing the proper pressure for combustion of the second gas fuel; in this case the gas fuel is natural gas and typically the gas jets 42 are of a conventional type having a #30 orifice so as to obtain a 1.25 MM Btu/hr rated capacity at 20 psig gas pressure and 0.2" W.C. draft for natural gas, assuming the distribution tubes 38 have an outside diameter of ¼" with a 1/32" wall. Such a standard gas jet is be acceptable for burning a fuel gas having a Wobbe index in the range of about 800 to 1600.

In the operation of the vortex burner 10 of the present invention either a low Wobbe gas such as natural gas, or a high Wobbe gas such as propane or butane will flow either through the first or second feed pipes 26 and 30 and then through either the first or second set of gas distribution tubes 36 or 38, respectively. Whichever gas flows through the vortex burner 10, a whirling pattern is imparted to the gaseous fuel as it exits from either set of gas jets. The fuel gas exiting from the gas jets then whirls toward the cup-shaped recess 14 to be burnt. The whirling gas mixes with air and the mixture ignites and is thrown by centrifugal force onto the cup-shaped recess 14 and out onto the inside surface of the furnace wall.

The vortex burner 10 of the present invention has been described as having a second feed pipe 30 disposed within the first feed pipe 26. However, another embodiment of the present invention anticipates that the first and second annular feed pipes are separately disposed within the burner tube 22. The first and second feed pipes would still carry gases of different Wobbe ratings and the first and second set of gas distribution tubes would be positioned as previously described. The operation of this second embodiment of the invention is essentially as that of the first embodiment.

Thus, the vortex burner of the present invention provides a furnace with the capability of burning either a low or high Wobbe gas without the inconvenience and expense of having to change the gas spuds.

Although this invention is usually practical with either a high Wobbe or a low Wobbe fuel, it is possible in some circumstances to burn both such fuels concurrently; the burning of either or both together is intended to be embraced by the terminology "either or" as used herein.

It will be apparent, of course, that the combustion supporting air for either the low Wobbe or high Wobbe gas passes substantially axially inwardly within the space between burner tube 22 and first feed pipe 26, and that this air enters into a whirling, mixing pattern induced by the tangential flow of the gas, just beyond the fence 24, and that this flow enters into the bowl formed by the surfaces 18, 16 and 14 for combustion therein.

Although this invention has been described with reference to specific forms thereof, certain modifications having been mentioned in the specification, it will be appreciated that a wide variety of other changes may be made without departing from the spirit and scope of the invention. For example, equivalent elements may be substituted for those specifically shown and described, parts may be reversed, and certain features may be used independently of other features, all without departing from the spirit and scope of the invention as defined in the appended claims.

I claim:

1. A vortex burner for burning either high or low Wobbe fuels comprising:

(a) a burner block having a cup-shaped recess at one surface of said block and an opening extending from the base of said cup-shaped recess and extending to the opposite surface of said block;

(b) a burner tube adjacent to and extending through said block opening, and terminating in the vicinity of the base of said cup-shaped recess, said burner tube having an annular shaped fence extending from its inner surface, said fence being disposed on the burner tube toward the base of said cup-shaped recess;

(c) a first feed pipe disposed within said burner tube;

(d) a second feed pipe disposed within said first feed pipe, said first feed pipe being capable of carrying a first fuel gas through its opening not occupied by the second feed pipe, said second feed pipe being capable of carrying a second fuel gas of either a higher or lower Wobbe index than that of said first fuel gas;

(e) a first set of gas distribution tubes extending from said first feed pipe, through the fence opening such that the terminal orifices of said tubes are at least in proximity to the front surface of said fence, said first set of gas distribution tubes being capable of carrying the first fuel gas which flows through that portion of the first feed pipe not occupied by said second feed pipe; and (f) a second set of gas distribution tubes extending from said second feed pipe, through the fence opening such that the terminal orifices of said tubes are at least in proximity to the front surface of said fence, said second set of gas distribution tubes being capable of carrying the second fuel gas which flows through the second feed pipe.

2. The vortex burner in accordance with claim 1, wherein said first set of gas distribution tubes are tangentially positioned about the front surface of said fence and said second set of gas distribution tubes are tangentially positioned about the front surface of said fence.

3. The vortex burner in accordance with claim 1, wherein said first set of gas distribution tubes are tangentially positioned about the front surface of said fence and said second set of tubes are spaced in proximity from said front surface of the fence by the tangentially positioned first set of tubes.

4. The vortex burner in accordance with claim 1, wherein said second set of gas distribution tubes are tangentially positioned about the front surface of said fence, and said first set of gas distribution tubes are spaced in proximity from the front surface of said fence by the tangentially positioned second set of tubes.

5. The vortex burner in accordance with claim 1, further comprising:

(g) a first set of gas jets on the terminal orifices of said first set of gas distribution tubes, said gas jets being suitable for providing the proper pressure for combustion of said first fuel; and (h) a second set of gas jets on the terminal orifices of said second set of gas distribution tubes, said gas jets being suitable for providing the proper pressure for combustion of said second gas fuel.

6. The vortex burner in accordance with claim 5, wherein said first set of gas jets have a #54 orifice.

7. The vortex burner in accordance with claim 5, wherein said second set of gas jets have a #30 orifice.

8. The vortex burner in accordance with claim 1, wherein said first fuel gas is propane.

9. The vortex burner in accordance with claim 1, wherein said first fuel gas is butane.

10. The vortex burner in accordance with claim 1, wherein said second fuel gas is natural gas.

11. The vortex burner in accordance with claim 1, wherein the low Wobbe fuel gas is in a range of about 800 to 1600.

12. The vortex burner in accordance with claim 1, wherein the high Wobbe fuel gas is in a range of about 1601 to 2300.

13. A vortex burner for burning either high or low Wobbe fuels comprising:

(a) a burner block having a cup-shaped recess at one surface of said block and an opening extending from the base of said cup-shaped recess and extending to the opposite surface of said block;

(b) a burner tube adjacent to and extending through said block opening, and terminating in the vicinity of the base of said cup-shaped recess, said burner tube having an annular shaped fence extending from its inner surface, said fence being disposed on the burner tube toward the base of said cup-shaped recess;

(c) a first feed pipe disposed within said burner tube;

(d) a second feed pipe disposed within said burner tube and separate from said first feed pipe, said first feed pipe being capable of carrying a first fuel gas through its opening, said second feed pipe being capable of carrying a second fuel gas of either a higher or lower Wobbe index than that of said first fuel gas;

(e) a first set of gas distribution tubes extending from said first feed pipe, through the fence opening such that the terminal orifices of said tubes are at least in proximity to the front surface of said fence, said first set of gas distribution tubes capable of carrying the first fuel gas which flows through the first feed pipe; and (f) a second set of gas distribution tubes extending from said second feed pipe, through the fence opening such that the terminal orifices of said tubes are at least in proximity to the front surface of said fence, said second set of gas distribution tubes being capable of carrying the second fuel gas which flows through the second feed pipe.

14. The vortex burner in accordance with claim 13, wherein said first set of gas distribution tubes are tangentially positioned about the front surface of said fence and the second set of gas distribution tubes are tangentially positioned about the front surface of said fence.

15. The vortex burner in accordance with claim 13, wherein said first set of gas distribution tubes are tangentially positioned about the front surface of said fence, and said second set of gas distribution tubes are each spaced approximately from the front surface of the fence by the tangentially positioned tube.

16. The vortex burner in accordance with claim 13, wherein said second set of gas distribution tubes are tangentially positioned about the front surface of said fence, and said first set of gas distribution tubes are spaced from the front surface of the fence approximately by the tangentially positioned tube.

17. The vortex burner in accordance with claim 13, further comprising:

(g) a first set of gas jets on the terminal orifices of said first set of gas distribution tubes, said gas jets are suitable for providing the proper pressure for combustion of said first fuel; and (h) a second set of gas jets on the terminal orifices of said second set of gas distribution tubes, said gas jets are suitable for providing the proper pressure for combustion of said second gas fuel.

18. The vortex burner in accordance with claim 17, wherein said first set of gas jets have a #54 orifice.

19. The vortex burner in accordance with claim 17, wherein said second set of gas jets have a #30 orifice.

20. The vortex burner in accordance with claim 13, wherein said first fuel gas is butane.

21. The vortex burner in accordance with claim 13, wherein said first fuel gas is propane.

22. The vortex burner in accordance with claim 13, wherein said second fuel gas is natural gas.

* * * * *

UNITED STATES PATENT AND TRADEMARK OFFICE

CERTIFICATE OF CORRECTION

PATENT NO. : 4,239,481

DATED : December 16, 1980

INVENTOR(S) : Charles W. Morck, Jr.

It is certified that error appears in the above-identified patent and that said Letters Patent are hereby corrected as shown below:

Column 1, line 56, "cup-shpaed" should read -- cup-shaped --.

Column 1, line 65, "capbable" should read -- capable --.

Column 2, line 26, "of FIG. 5" should read -- of FIG. 4 --.

Column 3, line 41, "be" should be deleted.

Column 4, line 21, "tantentially" should read -- tangentially--

Column 4, line 45, "be" should be deleted.

Signed and Sealed this

*Seventeenth* Day of *March 1981*

[SEAL]

*Attest:*

RENE D. TEGTMEYER

*Attesting Officer*

*Acting Commissioner of Patents and Trademarks*